United States Patent [19]

Lindahl

[11] 4,207,140

[45] Jun. 10, 1980

[54] METHOD OF PRODUCING GROUNDWOOD PULP

[75] Inventor: Jonas A. I. Lindahl, Domsjö, Sweden

[73] Assignee: Mo och Domsjo Aktiebolag, Ornskoldsvik, Sweden

[21] Appl. No.: 954,715

[22] Filed: Oct. 25, 1978

[30] Foreign Application Priority Data

Feb. 16, 1978 [SE] Sweden ..... 7801813

[51] Int. Cl.[2] ..... D21B 1/16

[52] U.S. Cl. ..... 162/23; 162/26; 162/29; 162/45; 162/46; 162/47; 162/55; 162/71; 162/78; 162/82; 162/87

[58] Field of Search ..... 162/23, 24, 45, 26, 162/28, 29, 46, 55, 71, 47, 78, 82, 87; 241/28

[56] References Cited

U.S. PATENT DOCUMENTS

| | | | |
|---|---|---|---|
| 3,808,090 | 4/1974 | Logan et al. | 162/28 |
| 4,029,543 | 6/1977 | Lindahl | 162/71 |
| 4,082,233 | 4/1978 | Reinhall | 162/28 |

FOREIGN PATENT DOCUMENTS

| | | | |
|---|---|---|---|
| 1266898 | 3/1972 | United Kingdom | 162/28 |

*Primary Examiner*—William F. Smith

[57] ABSTRACT

A process is provided for preparing groundwood pulp from debarked pulpwood logs, which comprises grinding the logs under a superatmospheric pressure of a gas selected from the group consisting of steam, air, and steam and air, while continuously supplying thereto water comprising spent bleaching liquor at a temperature of at least 70° C. and forming a pulp suspension in the resulting aqueous liquor; centrifugally separating steam from the pulp suspension and using the separated hot steam to heat spent bleaching liquor supplied for the grinding; thickening the pulp suspension to a concentration within the range from about 5 to about 40% and supplying water separated therefrom to the grinding; diluting the pulp suspension to a concentration within the range from about 0.5 to about 4.0%; screening the pulp suspension; thickening the pulp suspension to a concentration within the range from about 10 to about 50% and supplying water separated therefrom to the screening; adding bleaching chemicals to the pulp and bleaching the pulp; diluting the bleached pulp with spent bleaching liquor to a concentration within the range from about 1 to about 6%; thickening the bleached pulp suspension to a concentration within the range from about 10 to about 50%; and separating, heating and recycling to the grinding spent bleaching liquor containing residual bleaching chemicals.

16 Claims, 1 Drawing Figure

METHOD OF PRODUCING GROUNDWOOD PULP

Figure 1:
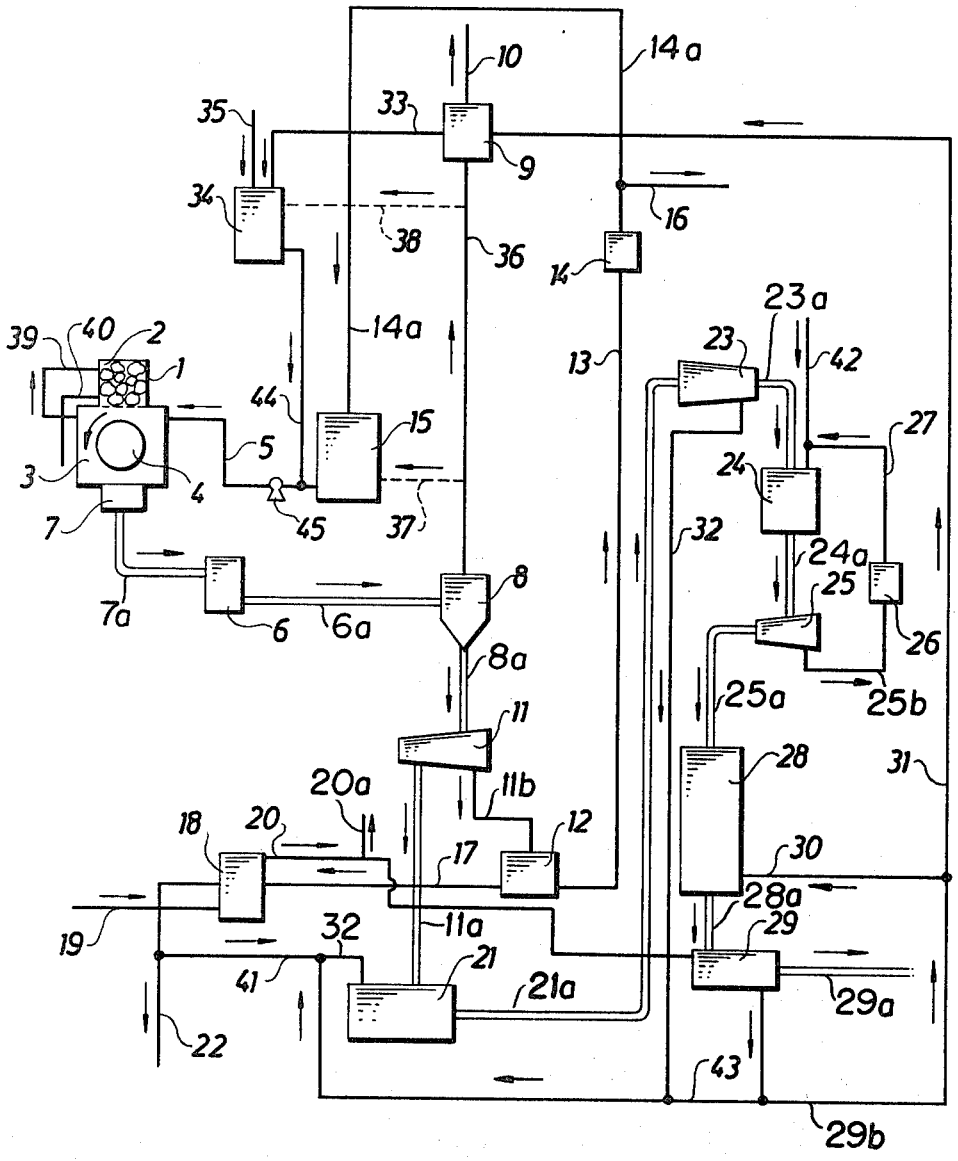

It has been found advantageous to carry out the grinding of debarked pulpwood logs in the production of groundwood pulp at elevated temperatures, since this reduces the energy requirement and facilitates defibration. It has also been suggested that it is especially advantageous to carry out the grinding under superatmospheric pressure in the presence of steam or air at an elevated temperature, since this further reduces energy consumption, and increases the tear resistance of the resulting pulp, as well as the freeness and bulk of the pulp produced.

Thus, Swedish Pat. No. 318,178 describes a method for the defibration of pulpwood logs by subjecting the material to grinding under a superatmospheric pressure of inert gas within the range from about 1.05 to about 10.5 kp/cm$^2$ above normal atmospheric pressure and preferably within the range from about 2.1 to about 7 kp/cm$^2$ above normal atmospheric pressure, while supplying water at at least 71° C. and preferably about 99° C. during the grinding. This process is said to provide a groundwood pulp having a better drainability and improved tear resistance, while the energy consumption is less than that normally required in the preparation of groundwood pulp.

U.S. Pat. No. 3,808,090, patented Apr. 30, 1974, to Logan and Luhde, in the text up to column 9, line 46, FIGS. 1 to 8 and Tables I to III is almost identical to the text of Swedish Pat. No. 318,178. The remainder of the Logan et al U.S. patent, from column 9, line 47 to column 13, line 42, is disclosed in Swedish Pat. No. 336,952, a patent of addition to No. 318,178, claiming the benefit of the priority of U.S. Ser. No. 569,351 of Aug. 1, 1966, now abandoned, referred to by Logan et al as a predecessor application to the application on which U.S. Pat. No. 3,808,090 issued. Swedish Pat. No. 336,952 includes Tables IV and V and FIG. 9 of the Logan et al U.S. Pat. No. 3,808,090.

The Logan et al U.S. patent during the mechanical abrasion of the wood applies a pressure within the range from about 0.7 to abbout 4.2 kp/cm$^2$, i.e., from 10 to 60 psig, with about 2.1 kp/cm$^2$ (30 psig) as a preferred range, a considerably narrower pressure range than that disclosed in Swedish Pat. No. 318,178.

Swedish Pat. No. 336,952 in this step applies a pressure within the range from about 1.4 to about 2.8 kp/cm$^2$, i.e., from 20 to 40 psig, which corresponds to the pressure disclosed in U.S. Pat. No. 3,948,449, patented Apr. 6, 1976. U.S. Pat. No. 3,948,449 in this step applies a pressure of from 10 to 80 psig (0.7 to 5.6 kp/cm$^2$), preferably from 20 to 40 psig (1.4 to 2.8 kp/cm$^2$).

However, it has been found that this process has numerous disadvantages. The brightness is unsatisfactorily low, by present-day standards, only about 48 to 54% GE being obtained, according to Table I, page 4, of the Swedish patent. If bleaching chemicals are added to the shower water, the brightness is not noticeably improved, being within the range from about 38 to about 55% GE, even though very large amounts of bleaching chemicals are added. Tensile strength, although better than for ordinary groundwood pulp, as well as tear index and smoothness, are not as high as would be desirable.

U.S. Pat. No. 4,029,543 to Lindahl, patented June 14, 1977, provides a process for the preparation of peroxide-bleached, mechanical cellulose pulps of improved brightness and strength. A mechanical freeing of the fibers is provided for instance by bringing the wood in the form of logs into contact with the surface of a rotating grindstone (groundwood) or grinding the wood in the form of chips in a disc refiner (refiner pulp). One further type of mechanical freeing can also be made in a so-called FROTAPULPER®, which is an apparatus principally consisting of two screws, which knead the wood material which is present in the form of large splinters, knots etc. In mechanical freeing of the fibers the pulp will contain all components of the original wood with the exception of the water soluble material.

The process is characterized by the fact that the mechanical freeing of the fibers is carried out in the presence of only spent liquor from the peroxide bleaching step, said liquor having a pH higher than 7.

The effect obtained is high brightness, improved strength and decreased consumption of chemicals.

In accordance with the present invention, energy requirements are further reduced and the quality of the groundwood pulp improved by grinding debarked pulpwood logs under a superatmospheric pressure of a gas selected from the group consisting of steam, air, and steam and air, while continuously supplying thereto water comprising spent bleaching liquor at a temperature of at least 70° C. and forming a pulp suspension in the resulting aqueous liquor; centrifugally separating steam from the pulp suspension and using the separated hot steam to heat the spent bleaching liquor supplied to the grinding; thickening the pulp suspension to a concentration within the range from about 5 to about 40% and supplying water separated therefrom to the grinding; diluting the pulp suspension to a concentration within the range from about 0.5 to about 4.0%; screening the pulp suspension; thickening the pulp suspension to a concentration within the range from about 10 to about 50% and supplying water separated therefrom to the screening; adding bleaching chemicals thereto and bleaching the pulp, diluting the bleached pulp with spent bleaching liquor to a concentration within the range from about 1 to about 6%; thickening the bleached pulp suspension to a concentration within the range from about 10 to about 50%; separating, heating and recycling to the grinding spent bleaching liquor containing residual bleaching chemicals.

The resulting groundwood pulp not only is obtained at a considerably lower energy consumption, but has substantially improved strength as well as greatly improved brightness, extending to as high as 80% SCAN. The groundwood pulp also has a very high content of flexible fibers, making possible the manufacture of paper with a lower grammage and a lower roughness than has heretofore been possible with groundwood pulps.

The groundwood pulps obtained in accordance with the invention can be mixed with chemical pulps, for example, sulphate or sulphite pulp, in a larger proportion than has heretofore been possible, thus reducing the manufacturing cost of paper manufactured therefrom. This groundwood pulp is also suitable for use in the manufacture of paper over a larger and more varied quality range than is usual in the case of groundwood pulps within the yield range of from 90 to 99%, due to a larger percentage of long fibers and higher strength.

The process of the invention also reduces the volume of water that needs to be discharged to waste from the process, thereby facilitating waste water purification. Since the steam emanating from the grinding step can be recovered and reutilized, the energy requirements are further reduced.

It is especially advantageous in applying the process of the invention to store the heated spent bleaching liquor separately before mixing it with process water from the first thickening step, and to lead the process water to a separate balance tank. Thereby heat and chemical losses are avoided. The heated liquor contains organic chemicals arising from the decomposition and dissolution of lignocellulosic material, including organic acids such as formic acid, acetic acid, oxalic acid, higher fatty and resin acids, organic complexing agents, and inorganic chemicals such as hydrogen peroxide, sodium dithionite, sodium hydroxide, sodium silicate, sodium phosphate and magnesium sulfate.

If desired, the heated spent bleaching liquor supplied to the grinding can also be supplied with stabilizers for the bleaching chemicals, such as magnesium sulfate, with complexing agents to chelate heavy metals, such as ethylenediamine tetracetic acid, nitrilotriacetic acid, and diethylene triamine pentaacetic acid, and fresh bleaching chemicals, as well as pH adjusting substances, such as alkali metal hydroxides and alkali metal silicates. These materials can be added to the liquor before or during storage.

The supply of water and spent bleaching liquor to the grinding can be by any conventional means. A high pressure pump is suitable, supplied with spent bleaching liquor and process water from the first thickening step to the suction side of the pump. The mixing of the water and spent bleaching liquor can take place before or after delivery to the pump. The proportion of preheated spent bleaching liquor and process water from the first thickening step depends on the process heat balance, especially the temperature used in the bleaching, and can be within the range from about 1:30 to about 5:1.

After separating large wood particles, steam is removed from the groundwood pulp suspension, preferably centrifugally, such as in a vortex separator or hydrocyclone, suitably by way of an intermediate pressure-seal tank. The separated steam is used to heat the spent bleaching liquor which is to be supplied to the grinding, and the heating preferably takes place by direct condensation of the steam in the liquor. Any excess steam is utilized for heating purposes in conjunction with the process or for other heating requirements. Thus, steam from the grinder can also be used for heating the debarked pulpwood logs in the air-lock feeder to the grinder.

In an especially advantageous embodiment of the invention, a portion of the process water tapped from the first thickening step is carried to a heat exchanger, and from there brought to the screening section, or ejected from the process. This makes it possible to regulate the temperature in the screening section and in the bleaching, as well as utilize excess heat from the process. It is advantageous to filter the water from the first thickening step to separate fibers and other suspended impurities before carrying it to the grinding.

Any known method for bleaching the groundwood pulp can be used, using, for example, chlorinating bleaching agents such as chlorine, hypochlorite and chlorine dioxide, and mixtures thereof; sodium peroxide, hydrogen peroxide and other peroxide bleaching chemicals; and sodium dithionite or sodium hydrosulphite.

The bleaching can be carried out in a bleaching tower and before bleaching it is advantageous to thicken the pulp suspension immediately after mixing with the bleaching chemicals and before introduction into the tower and to recycle the excess bleaching agent solution to the mixing apparatus after cooling.

During the grinding step, the superatmospheric pressure should be within the range from about 0.2 to about 10 kp/cm$^2$ above atmospheric pressure, and the temperature of the water or aqueous solution supplied to the grinding should be within the range from 85° to 100° C. Using debarked logs as the raw lignocellulosic material, the pressure of the logs against the grindstone surface should be within the range from about 4 to about 40 kp/cm$^2$ and preferably from about 6 to about 30 kp/cm$^2$.

FIG. 1 represents a preferred embodiment of the method of the invention, in flow sheet form.

In the groundwood pulp manufacturing system illustrated in FIG. 1, debarked pulpwood logs 1 with a moisture content within the range from about 30 to about 65% are carried by way of an air-lock feeder 2 into the grinding chamber of a closed pressure grinder 3, equipped with indicators for measuring temperature and pressure. The air-lock feeder 2 comprises a chamber with a movable bottom hatch and a movable top hatch. The logs are preheated in the feeder with steam admitted from the grinder via line 39. The feeder can also be supplied with steam from elsewhere in the process, to facilitate the preheating. Condensate is discharged via line 40.

The preheated logs are fed into the grinding chamber of the grinder 3 by opening the bottom hatch, so that the logs fall by gravity against the rotating grindstone 4. A hydraulic ram (not shown in the FIGURE) presses the logs against the grindstone at a sufficient pressure, within the range from about 4 to about 40 kp/cm$^2$, preferably from about 6 to about 30 kp/cm$^2$.

A superatmospheric pressure within the range from about 0.2 to about 10 kp/cm$^2$ above atmospheric pressure of steam, air or steam and air is maintained in the grinder 3. The particular superatmospheric pressure selected is determined by the pulp quality requirements. The better the quality of the pulp that is required, the higher should be the superatmospheric pressure, within the range specified.

Heated water is supplied by way of the line 5 and sprayed against the grindstone 4 continuously during the grinding process. The water is supplied at a rate of flow within the range from about 400 to about 2500 liters per minute at a production rate of 25 to 50 tons per day. The defibrated pulp from the grinder passes through the coarse crusher 7 where large particles are crushed and then enters the pressure-seal tank 6 via line 7*a*.

From the pressure-seal tank 6 the defibrated wood pulp as an aqueous suspension of pulp fibers in the water and other liquid added in the grinder is led via line 6*a* to the hydrocyclone 8, where steam is separated at a temperature within the range from about 100 to about 170° C. The separated steam is drawn off upwardly in line 36 to the condenser 9, where heat is transferred to the spent bleaching liquor supplied in line 31 from the bleaching tower 28, whence it is carried to the grinder 3 via lines 33, 44 and 5. The heat transfer in the condenser 9 is facilitated by direct condensation of the steam in the spent bleaching liquor. Excess steam from the condenser 9 passes through the line 10, for utilization somewhere else in the process or in the pulp manufacturing plant, such as (for example) in a flash dryer, steam turbine, or other industrial apparatus.

The separated pump suspension from the hydrocyclone 8 is carried to the dewatering apparatus 11 via line 8*a*, such as for example a press, where it is thickened from a concentration within the range from about 0.5 to 10% to a concentration within the range from about 5 to about 40%. The water separated in the thickener at a temperature at 95° to 100° C. is pumped via line 11*b* into storage tank 12. From there, water can be withdrawn via line 13 to the filter 14 and from there via line 14*a* to a balance tank 15, which is equipped with indicators for registering temperature and volume, and optionally also chemical concentration. A part of the filtered process water can be withdrawn from the system via the line 16.

Where necessary, a part of the process water from the press 11 can also be withdrawn via the line 17 and supplied to a heat exchanger 18 for heating freshwater supplied by the line 19 and taken off by the line 20. The process water can then be recycled to the screening stage 21 via lines 41, 32. A part of the water can be withdrawn from the system via the line 22.

From the press 11 the thickened pulp is taken via line 11*a* to the screening stage 21, where it is diluted to a concentration within the range from about 0.5 to about 4% with process water supplied by the line 32 from the second dewatering apparatus 23, and then screened. From the screening, the pulp suspension is carried via line 21*a* to the dewatering apparatus 23, suitably a press, where it is dewatered to a concentration of from 10 to 50%.

From the press 23 the pulp is taken via line 23*a* to the mixer 24, where bleaching chemicals, preferably hydrogen peroxide or sodium dithionite, are added via line 42, mixed with some bleaching solution recycled from the press 25 via line 27. Thereafter, the pump mixed with the bleaching chemicals passes through line 24*a* and is subjected immediately after mixing to a quick dewatering in the press 25. The bleaching solution forced out by press 25 is returned to the mixer 24 by way of the lines 25*b*, 27, after cooling in a heat exchanger 26.

The quick dewatering gives a higher brightness for a low chemical consumption, and is therefore preferred.

The dewatered pulp containing bleaching chemicals proceeds via line 25*a* to the bleaching tower 28, where it is subjected to bleaching at a temperature within the range from about 40° to about 75° C. and a concentration within the range from about 10 to about 50% for a suitable time, for instance, from 15 to 180 minutes. Before discharge from the tower, the pulp is diluted to a concentration within the range from about 1 to about 6% with spent bleaching liquor admitted to the bottom of the tower via line 30. The bleached pulp then proceeds via line 28*a* to a thickener 29, preferably a filter press, and thickened to a concentration within the range from about 10 to about 50% after which it is removed from the system via line 29*a* and dried, or taken directly to a paper mill.

Part of the spent bleaching liquor separated in the thickener 29 is recycled as diluting liquor in the bleaching tower 28 via lines 29*b*, 30 and part is led by the line 31 to the heat exchanger 9, where it is heated with steam from the hydrocyclone 8, then supplied by way of line 33 to a storage tank 34 where stabilizing agents and optionally fresh bleaching agent solution are added via line 35. If desired, a part of the spent bleaching liquor from the thickener 29 can also be recycled to the screening stage 21 via lines 43, 32.

Another suitable way of heating the spent bleaching liquor with steam from the hydrocyclone 8 is to carry the steam to the balance tank 15 via lines 36, 37 to the storage tank 34 by the lines 36, 38.

The following Examples in the opinion of the inventors represent preferred embodiments of the invention.

EXAMPLE 1

This Example illustrates the preparation of groundwood pulp from debarked spruce logs. For comparison, several conventional procedures of preparing groundwood pulp were used in order to demonstrate the advantages of the process in accordance with the invention. The following processes were used:

Control A: This method utilized the known grinding procedure of U.S. Pat. No. 4,029,543 patented June 14, 1977 to Lindahl at atmospheric pressure, spraying water containing spent bleaching liquor at ambient temperature on the grindstone.

Control B: This method applied the known grinding method of Swedish Pat. No. 318,178 using a closed grinder under superatmospheric pressure, spraying water without bleaching chemicals at an elevated temperature on the grindstone.

Control C: This method was the same as Control A, but carried out at superatmospheric pressure.

Control D: This method utilized grinding of the debarked logs in a closed grinder at superatmospheric pressure spraying water containing spent bleaching liquor, heating the water to elevated temperature with steam from outside the system.

Example 1, Method according to the invention:

This method was the same as Control D but used steam generated in the grinding instead of externally supplied steam.

To carry out the various Controls and Example 1, one of the open grinders in a groundwood plant containing eight grinders was converted to a closed pressure grinder, corresponding to the grinder 3 shown in FIG. 1, and provided with temperature and pressure indicators measuring the temperature and pressure within the grinder. Debarked spruce logs having an average moisture content of 51% were fed to the grinder as a 150 kg batch of dry wood. Pressure applied by a hydraulic ram to thrust the logs against the grindstone surface was 6 kp/cm$^2$. At this ram pressure, the power consumption of the grindstone driving motor was measured as 650 kWh/ton of pulp, both at atmospheric pressure and at increased pressure. Shower water was supplied to the grindstone surface at a rate of 600 liters per minute. In all the runs the system pressure inside the grinder was 1 kp/cm$^2$ above atmospheric, except in Control A, where atmospheric pressure was used.

The various methods used differed from one another in the following conditions.

Control A

The shower water temperature was 62° C., and the spray water was spent bleaching liquor having a pH of 8.5 from the tower bleaching step with the approximate composition:

| | |
|---|---|
| Hydrogen peroxide | 0.5 g/l |
| $Na_2SiO_3$ | 2.5 g/l |
| Ethylenediaminetetraacetic acid | 0.08 g/l |
| Acetic acid | 3.0 g/l |
| Resin and fatty acids | 0.2 g/l |

The temperature measured in the closed grinder was 65° C.

The groundwood pulp obtained was screened, supplied with EDTA complexing agent and dewatered from a 0.5 to 1% pulp consistency to a 13% pulp consistency on a filter. The brightness and paper properties of the unbleached pulp were then measured. The pulp was subsequently mixed with peroxide bleaching chemicals and bleached in a bleach tower in accordance with the method of the Example described in U.S. Pat. No. 4,029,543, column 4, line 25 to column 5, line 12.

Control B

The shower water consisted of tap water at 96° C. The temperature in the closed grinder was 112° C. The pulp obtained was screened, dewatered and dried. The brightness and paper properties of the pulp were measured.

This method corresponds to the method described in Swedish Pat. No. 318,178, at page 2, line 32 to page 9, line 21 and Tables 1 and 2.

Control C

Control A was followed with the difference that the grinding was carried out at a superatmospheric pressure of 1 kp/cm$^2$ above atmospheric. The temperature in the closed grinder was 70° C. On discharge from the grinder the pulp consistency was measured, and found to be 2.72%. The pulp suspension was centrifuged in a hydrocyclone to remove steam, and dewatered in a screw press to a pulp consistency of 23%. The pulp was subsequently screened, dewatered, and dried, after which its brightness and paper properties were measured.

Control D

The process of Control C was followed, except that the process water from the screw press containing spent bleaching liquor was heated with external steam from a boiler to a temperature of 99.5° C., and used as shower water in the grinder. The temperature in the closed grinder was 112° C. The pulp consistency on discharge from the grinder was 2.89%.

EXAMPLE 1

This process was the same as Control D, with the difference that the process water from the screw press 11 containing spent bleaching liquor and having a temperature of 96° C. was used in part as shower water in the grinder, with an addition of 5% by volume of spent bleaching liquor from the bleaching tower 28, which had been heated in condenser 9 by steam from the hydrocyclone 8 to a temperature of 99° C. The grinder temperature was 113° C.

The pulp properties of the groundwood pulps obtained in the above procedures are compared in Table I below.

TABLE I

| CONTROL | A | B | C | D | Example 1 |
|---|---|---|---|---|---|
| Energy consumption for defibration, kWh/ton | 1150 | 1025 | 1100 | 950 | 950 |
| Energy consumption for heating shower water, kWh/ton | 0 | 1200 | 0 | 1200 | 0 |
| Freeness, ml | 140 | 145 | 150 | 145 | 157 |
| Tensile index,[1] Nm/kg | 29 | 28 | 28 | 34 | 36 |
| Tear index,[2] Nm$^2$/kg | 3.5 | 4.5 | 3.7 | 5.3 | 5.6 |
| Density, kg/m$^3$ | 404 | 392 | 402 | 380 | 378 |
| Brightness,[3] % | 66 | 59 | 65 | 66 | 65 |
| Opacity,[4] % | 91.8 | 92.5 | 92.2 | 91.9 | 92.3 |

[1]Tensile strength/grammage
[2]Tear resistance/grammage
[3]SCAN-C 11:62
[4]SCAN-C 27:69

It is apparent from the Table that the groundwood pulp produced in accordance with Example 1 is superior overall to all of the other groundwood pulps of the Controls.

The pulp of Example 1 in comparison with the groundwood pulp obtained from Control B has a 10% higher brightness before bleaching, which makes it possible to achieve a final brightness of 80% in a subsequent bleaching process. This is considerably higher than can be achieved with the groundwood pulp of Control B. Moreover, this brightness is obtained at a very small chemical cost, due to recycling of spent bleaching liquor.

The groundwood pulp of Example 1 had a tear index about 24% higher than Control B, and about 60% higher than Control A, the process of U.S. Pat. No. 4,029,543, and Control C, the process of U.S. Pat. No. 4,029,543 with increased pressure. Thus, the groundwood pulp produced in accordance with the present invention is well suited to the production of paper in a paper machine, since the risk of wet rupture is substantially reduced.

Tensile index is an approximate measurement of how far a paper strip can be pulled out of the pulp before the strip ruptures of its own weight. In this property, the groundwood pulp of Example 1 was about 29% better than the pulp produced in accordance with Swedish Pat. No. 318,178.

While all the Control pulps are equal to freeness, the pulp of Example 1 is superior to all of them.

The lower density of the groundwood pulp of Example 1 in relation to the groundwood pulps of Controls A, B and C makes the pulp of the invention especially suitable for the production of printing paper and paperboard with low grammage.

As is apparent from the Table, the method according to the invention results in a considerable decrease in the total energy consumption in the defibration in the grinder, in comparison with the Controls.

By recovering and utilizing steam from the grinding, the process also gives the advantage that the groundwood pulp can be produced at high temperature without need for external steam, thus saving very large amounts of energy, about 1200 kWh, compared to Controls B and D, and as much as 1450 kWH, per ton of pulp, if excess steam from the grinder is used for preheating the wood. Wear on the grindstones is also reduced by preheating the wood, due to lower heat stresses in the stone material.

Thus, the process of the invention makes possible the production of a stronger groundwood pulp at a far lower consumption of energy than the conventional methods. At the same time, the pulp has a surprisingly high brightness, in spite of the repeated recycling of spent bleaching liquor, which could be expected to discolor the pulp, owing to the accumulation of dark-colored substances.

EXAMPLE 2

This Example illustrates plant-scale production of groundwood pulp in accordance with the present invention in a plant utilizing the flow scheme of FIG. 1.

Debarked spruce logs 1 with a moisture content of 49% were put in the air-lock feeder 2 provided with hatches, and preheated with excess steam from the grinder, the steam being supplied to the feeder by way of the line 39 regulated by a pressure-regulating valve (not shown). Condensate from the feeder was discharged by the line 40. After introducing the logs into the closed grinder 3, they were pressed against the grindstone 4 by a hydraulic ram under a piston pressure of 7 kp/cm$^2$. A superatmospheric pressure of steam and air of 1 kp/cm$^2$ above atmospheric was maintained in the grinder. The flow rate of shower water at 99° C. through the line 5 was 800 liters per minute, and 5.5% by volume of the water was heated spent bleaching liquor from the storage vessel 34.

The pulp suspension had a pulp concentration of 2.38% on discharge from the grinder and a temperature of 111° C. Steam at a temperature of 101° C. was separated in the hydrocyclone 8. The separated steam was taken by line 36 to the direct condenser 9 and condensed in spent bleaching liquor from the line 31 to preheat the liquor. 2.2 kg steam per minute was taken from the condenser via the line 10 at a temperature of 100° C., and used to preheat the drying air in a flash drier.

The pulp was taken from the hydrocyclone to a screw press 11, where it was thickened from a pulp concentration of 2.4% to a pulp concentration of 24%. The process water separated from the press had a temperature of 98° C. 720 liters per minute of this water were pumped via the reservoir 12 and line 13 to the filter 14, where the fibers and suspended solid impurities were separated, and from there to the balance tank 15 via line 14*a*. About 16 liters per minute of the process water from the reservoir 12 was taken via the line 17 to the heat exchanger 18 to heat fresh water supplied by line 19. The fresh water heated to a temperature of 50° C. was led by line 20 to the filter press 29 for use as spray water. The process water after passing the heat exchanger 18 had a temperature of 60° C., and was supplied in toto via line 41 to the screening stage 21. If desired, hot water can be withdrawn from line 20 and used elsewhere via line 20*a*.

From the press 11, the pulp was taken to the screening stage 21, where it was diluted to a pulp concentration of 1.0% with the process water supplied through the line 32 and the process water from the heat exchanger via line 41.

From the screening stage 21 the screened pulp which had a pulp concentration of 0.8% was taken to the dewatering apparatus 23, consisting of a combined tubular screw dewaterer screw press, where it was dewatered to a pulp concentration of 26%. From the apparatus 23 the pulp was taken to the mixer 24, which was supplied via line 42 with fresh bleaching agnet solution containing 2.8% hydrogen peroxide, 4% sodium silicate and 1.2% sodium hydroxide, calculated on the weight of dry pulp. Recycled cooled bleaching agent solution was also taken to the mixer via line 27, in such an amount that the outgoing pulp suspension had a pulp concentration of 12%. Immediately after mixing in the mixer 24, the pulp suspension containing bleaching agent was dewatered in the screw press 25 to a pulp concentration of 24%, and then was taken to the bleaching tower 28.

The bleaching agent solution pressed out of the pulp in the press 25 was cooled in the cooler 26 to a temperature of 40° C., before recycling to the mixer 24. The pulp was bleached in the tower 28 at a temperature of 58° C. for 1.5 hours. Before discharge from the tower, the pulp was diluted to a pulp concentration of 4% by adding spent bleaching liquor at a flow rate of 416 liters per minute via line 30 from the filter press 29. The pulp was thickened to a 50% pulp concentration in the filter press 29.

Spent bleaching liquor at a flow rate of 44 liters per minute and a temperature of 58° C. was taken to the steam condenser 9 via the line 31. This liquor was heated in the condenser 9 to 98° C., after which it was brought to the storage vessel 34. $MgSO_4.7H_2O$, 0.05%, and diethylenetriamine pentaacetic acid (DTPA), 0.03%, calculated on the dry weight of the wood, were added via line 35 to the storage vessel 34. Liquor from the storage vessel 34 was taken via line 44 to the suction side of the high pressure pump 45.

The energy consumption for defibration was 1150 kWh/ton of pulp. The bleached groundwood pulp obtained had the following properties:

| | |
|---|---|
| Freeness | 108 ml |
| Tensile index | 43 Nm/kg |
| Tear index | 5.6 Nm$^2$/kg |
| Density | 415 kg/m$^3$ |
| Brightness | 80% |
| Opacity | 91.2% |

The addition of stabilizing agents in the storage vessel 34 together with the effect of spent bleaching liquor and the specific bleaching process used resulted in a surprisingly high brightness for a bleached groundwood pulp. Energy consumption was very low, in spite of the low freeness, and about 1450 kWh/ton of pulp was saved in steam energy by utilizing the heat generated in the process.

Paper was manufactured on a pilot paper machine from about 1 ton of the groundwood pulp prepared in accordance with Example 2. For comparison purposes, paper was also prepared from another batch of the groundwood pulp prepared according to the Example of U.S. Pat. No. 4,029,543 (see Control A of Example 1) and from a commercial thermomechanical pulp, this being generally regarded as the strongest of all known mechanical pulps. All of the pulps were bleached.

The paper properties of the pulps and production energy consumption are summarized in the Table II below. The groundwood pulp of Example 2 had a lower freeness than in Example 1, in order to reduce the roughness of the paper manufactured.

TABLE II

| | Thermo-mechanical pulp | Groundwood pulp of Pat. No. 4,029,543 | Ground-wood pulp of Example 2 |
|---|---|---|---|
| Energy consumption kWh/ton | 2100[1] | 1350 | 1150 |
| Freeness, | | | |

TABLE II-continued

| | Thermo-mechanical pulp | Groundwood pulp of Pat. No. 4,029,543 | Ground-wood pulp of Example 2 |
|---|---|---|---|
| C.S.F., ml | 110 | 105 | 108 |
| Tensile index, Nm/kg | 38 | 35 | 43 |
| Tear index, $Nm^2/kg$ | 6.8 | 3.7 | 5.6 |
| Density, $kg/m^3$ | 410 | 423 | 415 |
| Brightness, % | 76 | 78 | 80 |
| Opacity, % | 90.8 | 91.2 | 91.2 |

[1]Determined by measurement in the production of conventional thermomechanical pulp.

It is apparent from Table II that nearly twice as much energy was required for producing the thermomechanical pulp as for producing groundwood pulp in accordance with the invention. While the thermomechanical pulp has the highest tear index value, the groundwood pulp of Example 2 is superior overall in properties.

Before paper manufacture, the respective mechanical pulps were mixed in a proportion of 60% with 40% of fully bleached pine sulphate pulp ground to a freeness of 450 ml (grinding degree 28°, according to Schopper-Riegler) with a brightness of 91.2% SCAN. The properties of the finished papers obtained from these three pulps are given in Table III.

TABLE III

| | Thermo-mechanical pulp | Ground-wood pulp of Pat. No. 4,029,543 | Ground-wood pulp of Example 2 |
|---|---|---|---|
| Grammage/$m^2$ | 81.8 | 81.9 | 81.8 |
| Ash content, % | 7 | 7 | 7 |
| Tensile index, Nm/kg (mean value longitudinal and transverse) | 42.3 | 43.4 | 50.5 |
| Tear index, N . $m^2$/kg | 7.2 | 6.1 | 8.0 |
| Stretch, % (mean value longitudinal and transverse) | 2.1 | 2.0 | 3.2 |
| Light-scattering coefficient, $m^2/kg$ | 38.3 | 46.8 | 50.2 |
| Brightness, % | 78.5 | 79.5 | 80.5 |
| Opacity, % | 86.6 | 87.8 | 90.1 |
| Density, $kg/m^3$ | 513 | 537 | 516 |
| Roughness, Bendtsen, SCAN-P 21:67, ml/min (mean value upper and wire side) | 340 | 320 | 150 |

As is apparent from Table III, paper from groundwood pulp prepared in accordance with the invention is surprisingly stronger than paper from thermomechanical pulp. Especially surprising are the tear index and stretch, which also are greater than for the paper from thermomechanical pulp, even though this pulp, according to the data in Table II, has the highest tear index value.

There is no way to explain why the pulp in accordance with the invention gives such a strong paper in admixture with chemical pulp. Fiber morphology studies show however that the fibers appear to be released or exposed in a different way in defibration according to the invention than in the usual groundwood pulp manufacture and in thermomechanical pulp manufacture. In the pulp manufacturing process of the invention, the individual fibers appear to be liberated from the primary wall and the first outer secondary wall of the lignocellulosic material, so that the middle lamella (consisting virtually of lignin) is surrounded by cellulose. The fibers furthermore appear to be well fibrillated and flexible, which favors fiber-to-fiber bonds in the manufacture of paper.

In conventional stone grinding, the fibers are frequently broken right through, resulting in shortening of the fibers, and also the fibers appear to be straight and stiff. In the thermomechanical pulping process, fiber exposure often continues right through the middle lamella and the cellulose primary wall. The result is that certain fibers get a coating of lignin from the middle lamella, which results in weak fiber-to-fiber bonds in the production of paper.

Thus, in summary, the process of the invention gives a lower manufacturing cost for groundwood pulp than has heretofore been possible. The energy consumption is not only substantially reduced, in achieving a specified strength in the paper, but a paper may even be obtained having better formation, and greater opacity. Furthermore, paper with lower grammage can be manufactured, while still retaining normal paper properties. In the manufacture of paper from mixtures with chemical pulps, such as sulphate pulp or sulphite pulp, the weight proportion of the chemical pulp can be reduced, giving a paper with unaltered or better properties, but at a lower manufacturing cost. The opacity of the paper is increased, due to a higher percent of mechanical pulp, which favors the printing properties of the paper.

By recycling the shower water according to the invention, there is also obtained a recycled equilibrium concentration of dissolved-out wood substances, which facilitates recovery and processing of waste water, and also inhibits the losses of such soluble wood substances from the pulp fibers.

Having regard to the foregoing disclosure, the following is claimed as the inventive and patentable embodiments thereof:

1. A process for preparing groundwood pulp of improved quality and with reduced energy requirements, which comprises:

(1) grinding debarked pulpwood logs under a superatmospheric pressure of a gas selected from the group consisting of steam, air and steam and air while continuously supplying thereto water and spent bleaching liquor at a temperature of at least 70° C. and forming a pulp suspension in the resulting aqueous liquor;

(2) centrifugally separating steam from the pulp suspension and using the separated hot steam to heat the spent bleaching liquor supplied to the grinding;

(3) thickening the pulp suspension to a pulp concentration within the range from about 5 to about 40% and supplying water separated therefrom to the grinding;

(4) diluting the pulp suspension to a pulp concentration within the range from about 0.5 to about 4.0%;

(5) screening the pulp suspension;

(6) thickening the pulp suspension to a pulp concentration within the range from about 10 to about 50% and supplying water separated therefrom to the screening;

(7) adding bleaching chemicals thereto and bleaching the pulp;

(8) diluting the bleached pulp with spent bleaching liquor to a pulp concentration within the range from about 1 to about 6%;

(9) thickening the bleached pulp suspension to a pulp concentration within the range from about 10 to about 50%; and

(10) separating, heating and recycling to the grinder spent bleaching liquor containing residual bleaching chemicals.

2. A process according to claim 1 in which only water and spent bleaching liquor from the process are supplied to the grinding, and only hot steam or water from the process are applied to heat the spent bleaching liquor and water supplied to the grinding.

3. A process according to claim 1 which comprises separately storing the heated spent bleaching liquor and the process water from the first thickening step before mixing and supplying to the grinding.

4. A process according to claim 1 in which the heated spent bleaching liquor supplied to the grinding is supplied with stabilizers for the bleaching chemicals present.

5. A process according to claim 1 in which the heated spent bleaching liquor supplied to the grinding is supplied with complexing agents to chelate heavy metals.

6. A process according to claim 1 in which the heated spent bleaching liquor supplied to the grinding is supplied with fresh bleaching chemicals.

7. A process according to claim 1 which comprises adjusting the proportion of preheated spent bleaching liquor and process water from the first thickening step within the range from about 1:30 to about 5:1 according to the process heat balance and grinding conditions.

8. A process according to claim 1 which comprises after grinding separating large wood particles and then separating the steam therefrom in a hydrocyclone.

9. A process according to claim 1 which comprises separating steam from the grinder and heating therewith the debarked pulpwood logs fed to the grinder.

10. A process according to claim 1 in which a portion of the process water tapped from the thickening step (3) is carried to a heat exchanger, and from there brought to the screening stage (5).

11. A process according to claim 1 which comprises filtering the water from the thickening step (3) to separate fibers and other suspended impurities before carrying it to the grinding.

12. A process according to claim 1 in which the bleaching of the groundwood pulp uses a bleaching agent selected from the group consisting of chlorinating bleaching agents, peroxide bleaching chemicals and sodium dithionite.

13. A process according to claim 1 in which the bleaching is carried out in a bleaching tower, and the pulp suspension is thickened immediately after mixing with the bleaching chemicals and before introduction into the tower, and the excess bleaching liquor recycled to the bleaching chemicals addition step (7).

14. A process according to claim 1 in which during the grinding step, the superatmospheric pressure is maintained within the range from about 0.2 to about 10 $kp/cm^2$ above atmospheric pressure, the temperature of the water or aqueous solution supplied to the grinding is maintained within the range from about 85° to about 100° C., and the pressure of the logs against the grindstone surface is maintained within the range from about 4 to about 40 $kp/cm^2$.

15. A process according to claim 1 in which the groundwood pulp obtained is mixed with chemical pulp, in a proportion within the range from about 1:9 to about 9:1.

16. A process according to claim 15 in which the groundwood chemical pulp mixture is used for the manufacture of paper.

* * * * *

UNITED STATES PATENT AND TRADEMARK OFFICE

CERTIFICATE OF CORRECTION

PATENT NO. : 4,207,140

DATED : June 10, 1980

INVENTOR(S) : Jonas A. I. Lindahl

It is certified that error appears in the above-identified patent and that said Letters Patent are hereby corrected as shown below:

Column 3, line 24: "tetracetic" should be --tetraacetic--.
Column 9, line 65: "agnet" should be --agent--.
Column 10, last line: "Freeness" should be deleted
Table II

TABLE II

| | Thermo-mechanical pulp | Groundwood pulp of Pat. No. 4,029,543 | Ground-wood pulp of Example 2 |
|---|---|---|---|
| Energy consumption kWh/ton | 2100[1] | 1350 | 1150 |
| Freeness, | | | |

should be

TABLE II

| | Thermo-mechanical pulp | Groundwood pulp of Pat. No. 4,029,543 | Ground-wood pulp of Example 2 |
|---|---|---|---|
| Energy consumption kWh/ton | 2100[1] | 1350 | 1150 |

UNITED STATES PATENT AND TRADEMARK OFFICE

CERTIFICATE OF CORRECTION

PATENT NO. : 4,207,140

DATED : June 10, 1980

INVENTOR(S) : Jonas A.I. Lindahl

It is certified that error appears in the above-identified patent and that said Letters Patent are hereby corrected as shown below:

Column 11, Table II line 5 : Please insert --freeness-- before "C.S.F., ml"

TABLE II-continued

| | Thermo-mechanical pulp | Groundwood pulp of Pat. No. 4,029,543 | Ground-wood pulp of Example 2 |
|---|---|---|---|
| C.S.F., ml | 110 | 105 | 108 |
| Tensile index, Nm/kg | 38 | 35 | 43 |
| Tear index, $Nm^2/kg$ | 6.8 | 3.7 | 5.6 |
| Density, $kg/m^3$ | 410 | 423 | 415 |
| Brightness, % | 76 | 78 | 80 |
| Opacity, % | 90.8 | 91.2 | 91.2 |

[1]Determined by measurement in the production of conventional thermomechanical pulp.

should be

UNITED STATES PATENT AND TRADEMARK OFFICE

CERTIFICATE OF CORRECTION

PATENT NO. : 4,207,140

DATED : June 10, 1980

INVENTOR(S) : Jonas A.I. Lindahl

It is certified that error appears in the above-identified patent and that said Letters Patent are hereby corrected as shown below:

TABLE II

| | Thermo-mechanical pulp | Groundwood pulp of Pat. No. 4,029,543 | Ground-wood pulp of Example 2 |
|---|---|---|---|
| Freeness, C.S.F., ml | 110 | 105 | 108 |
| Tensile index, Nm/kg | 38 | 35 | 43 |
| Tear index, $Nm^2/kg$ | 6.8 | 3.7 | 5.6 |
| Density, $kg/m^3$ | 410 | 423 | 415 |
| Brightness, % | 76 | 78 | 80 |
| Opacity, % | 90.8 | 91.2 | 91.2 |

[1]Determined by measurement in the production of conventional thermomechanical pulp.

Signed and Sealed this

*Twenty-first* Day of *October 1980*

[SEAL]

*Attest:*

SIDNEY A. DIAMOND

*Attesting Officer*

*Commissioner of Patents and Trademarks*